US006786159B2

(12) United States Patent
De Fleury et al.

(10) Patent No.: US 6,786,159 B2
(45) Date of Patent: Sep. 7, 2004

(54) SAFE RAIL VEHICLE TILT CONTROL METHOD

(75) Inventors: Bernard Auge De Fleury, Noisy le Grande (FR); Stéphane Feray-Beaumont, Viry Chatillon (FR)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/270,656

(22) Filed: Oct. 16, 2002

(65) Prior Publication Data

US 2003/0075071 A1 Apr. 24, 2003

(30) Foreign Application Priority Data

Oct. 23, 2001 (FR) ..... 01 13661

(51) Int. Cl.[7] ..... B61F 5/02

(52) U.S. Cl. ..... 105/199.2; 105/199.1; 701/19

(58) Field of Search ..... 105/199.2, 199.1, 105/171; 701/19, 20, 36, 37; 246/122 R, 182 R, 182 B, 167 R; 280/111.2

(56) References Cited

U.S. PATENT DOCUMENTS 4,355,582 A 10/1982 Germer
5,170,716 A * 12/1992 Durand et al. ..... 105/199.2
5,285,729 A * 2/1994 Bangtsson et al. ..... 105/199.2
5,295,443 A * 3/1994 Bangtsson et al. ..... 105/199.2
5,311,821 A * 5/1994 Lang et al. ..... 105/199.2
5,787,815 A * 8/1998 Andersson et al. ..... 105/199.2
6,108,596 A * 8/2000 Beike ..... 701/19
6,498,969 B2 * 12/2002 Alacoque et al. ..... 701/19

FOREIGN PATENT DOCUMENTS

DE 39 35 740 A 5/1991
DE 44 36 137 A 4/1996
DE 195 20 824 A 12/1996

* cited by examiner

*Primary Examiner*—Frantz F. Jules
(74) *Attorney, Agent, or Firm*—Sughrue Mion, PLLC

(57) ABSTRACT

In a safe method of controlling the tilt of a rail vehicle traveling on a track, different sections of the track are allocated authorized tilt limit values representative of a safety gauge within which the train can tilt without risk of colliding with infrastructures near the tracks or a vehicle traveling in the opposite direction. All tilting of the vehicle is prohibited beyond authorized tilt limit values allocated to the track section on which the vehicle is located.

8 Claims, 4 Drawing Sheets

SAFE RAIL VEHICLE TILT CONTROL METHOD

BACKGROUND OF THE INVENTION

1. Field of the Invention

The invention relates generally to a safe method of controlling tilting of a rail vehicle and more particularly to a control method ensuring a high level of protection against collisions of tilting vehicles.

2. Description of the Prior Art

The increasing need to reduce the travel times of trains on existing tracks has recently led to the development of tilting trains which can negotiate curves at higher speeds. Tilting trains usually have an automatic tilt control system, for example that described in French patent application FR 2 794 707, for precisely adjusting the tilt of the vehicle as a function of the geometry of the track and the kinematics of the vehicle to ensure the greatest passenger comfort when negotiating curves.

However, tilting vehicles raise new safety problems relating to tilting of the vehicle body, which gives rise to risks of colliding with infrastructures alongside the track (posts, tunnel walls, etc.) or with a train on an adjacent track, especially in the event of failure of the automatic tilt control system.

Also, one object of the present invention is to propose a safe method of controlling the tilting of a rail vehicle that improves safety by ensuring that the contour of the rail vehicle remains at all times within a safety gauge, referred to as the OFG (obstacle-free gauge), defined at any point on the track.

SUMMARY OF THE INVENTION

To this end, the invention provides a safe method of controlling the tilt of a rail vehicle traveling on a track, in which method different sections of the track are allocated authorized tilt limit values representative of a safety gauge within which the train can tilt without risk of colliding with infrastructures near the track or a vehicle traveling in the opposite direction, and all tilting of the vehicle is prohibited beyond authorized tilt limit values allocated to the track section on which the vehicle is located.

Particular embodiments of the safe tilt control method according to the invention can have one or more of the following features, separately or in all technically feasible combinations:

- the vehicle incorporates cars whose tilting is controlled by an automatic control system for tilting said cars as a function of the kinematics of the vehicle and the geometry of the track, and, independently of commands issued by the automatic tilt control system, for each car of the vehicle, all tilting is prohibited beyond authorized tilt limit values allocated to the track section on which said car of the vehicle is located;
- tilting of the cars of the vehicle is prohibited beyond authorized tilt limit values by means of mobile mechanical buffers bearing on the chassis of the bogies of the cars and actuated by actuators, the buffers mechanically preventing tilting of the car beyond a particular tilt, the vehicle including a safe onboard automatic tilt protection system preventatively controlling movement of the mechanical buffers on each bogie of the cars as a function in particular of known authorized tilt limit values;

- after sending instructions controlling the buffers, the safe onboard automatic tilt protection system checks the positions of the buffers by means of sensors;
- tilting of the cars beyond authorized tilt limit values is prevented by a safe automatic tilt protection system on board the vehicle which continuously measures the actual tilt of the cars of the vehicle using sensors, the safe automatic tilt protection system inhibiting any control instruction sent by the automatic tilt control system that would tilt the cars of the vehicle beyond the authorized tilt limit values;
- the tilt of the car is zeroed, accompanied if necessary by emergency stopping of the vehicle, if the tilt values measured for a car exceed the authorized tilt limit values for the track section on which the car is located;
- the tilt limit values relating to the track section on which the vehicle is traveling are produced from limit tilt indicative values acquired by the tilt automatic protection safety system on board the vehicle from a beacon disposed upstream of the track section;
- the limit tilt indicative values acquired on passing beacons for each of the track sections on which the vehicle travels are stored in a memory on board the vehicle and processed by the safe automatic tilt protection system as a function of the known position of the vehicle on the track; and
- the limit tilt indicative values transmitted by the beacons correspond to authorized tilt limit values specific to a vehicle of a given type and, if the vehicle traveling on the track is of a different type, the safe automatic tilt protection system on board that vehicle holds vehicle customizing correction coefficients enabling it to calculate authorized tilt limit values suitable for the type of vehicle actually traveling on the track.

The objects, aspects and advantages of the present invention will be understood better from the following description of particular embodiments of the invention, which description is given by way of non-limiting example and with reference to the accompanying drawings.

DETAILED DESCRIPTION OF THE PREFERRED EMBODIMENTS

To simplify the drawings, only components necessary to understanding the invention are shown. The same components carry the same reference numbers from one figure to another.

The remainder of the description considers a tilting rail vehicle 5 made up of three cars $V_1$, $V_2$, $V_3$ incorporating a prior art automatic tilt control system, for example that described in application FR 2 794 707, which system tilts the cars of the vehicle as a function of the geometry of the track and the kinematics of the vehicle.

Figure 1:
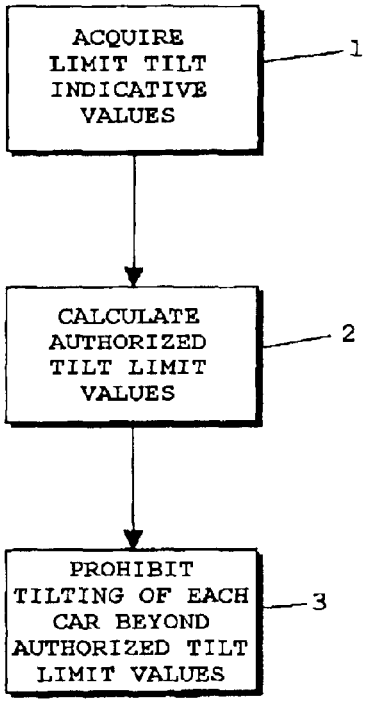
FIG. 1 shows the general architecture of a first embodiment of a safe control method according to the invention.

FIG. 1 shows the general architecture of a first embodiment of a safe tilt control method according to the invention. The method is implemented by a safe automatic protection system on board the vehicle 5 which operates in parallel with and independently of the automatic tilt control system of the vehicle 5.

As shown in FIG. 1, the safe tilt control method includes a first step 1 corresponding to acquisition by the safe automatic protection system on board the rail vehicle 5 of limit tilt indicative values ($\alpha_1$, $\alpha_2$) allocated to the section of track onto which the rail vehicle is about to move.

Figure 4:
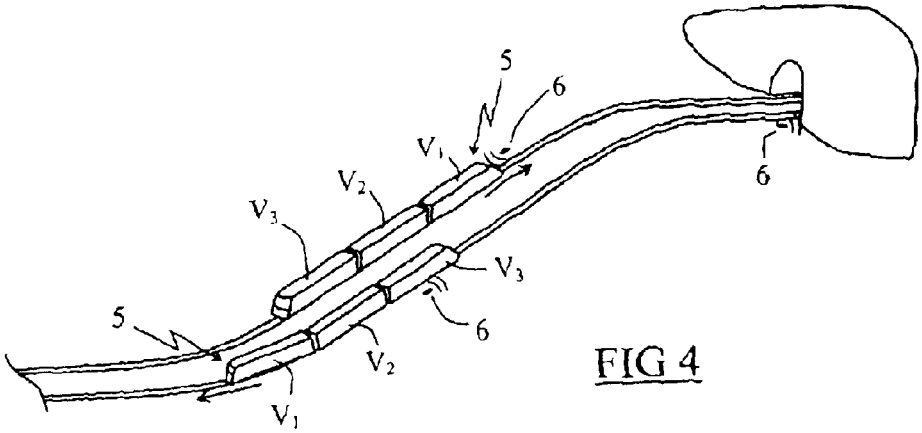
FIG. 4 shows two tilting rail vehicles traveling on tracks divided into sections, which are assigned different authorized tilt limit values as part of the safe control method according to the invention.

The limit tilt indicative values ($\alpha_1$, $\alpha_2$) are preferably acquired by means of beacons 6 disposed along the tracks, as shown in FIG. 4, each beacon 6 enabling a rail vehicle to acquire limit tilt indicative values ($\alpha_1$, $\alpha_2$) defined for the section of track downstream of the beacon 6.

The limit tilt indicative values ($\alpha_1$, $\alpha_2$) read from the beacon 6 correspond to authorized tilt limit values ($\beta_1$, $\beta_2$) for a rail vehicle of a given type, preferably corresponding to the type of tilting vehicle most often traveling on the track concerned. If the vehicle actually traveling on the track differs from the standard vehicle for which the limit tilt indicative values ($\alpha_1$, $\alpha_2$) are valid, those values are then corrected by means of correction coefficients stored in the safe automatic protection system on board the tilting vehicle concerned, to obtain authorized tilt limit values ($\beta_1$, $\beta_2$) for the vehicle actually traveling on the track. Such corrections take into account different overall sizes of tilting vehicles that can travel on the same track.

In a second step 2 of the method, the safe automatic protection system on board the vehicle calculates the various corresponding authorized tilt limit values ($\beta_{1i}$, $\beta_{2i}$) for each of the cars $V_i$, $i \in [1,3]$, constituting the rail vehicle 5. To this end, the safe protection system continuously calculates the position of the cars relative to the beacons 6 disposed along the track, for example using the speed of the vehicle and the known lengths of the cars $V_i$.

Figure 3:
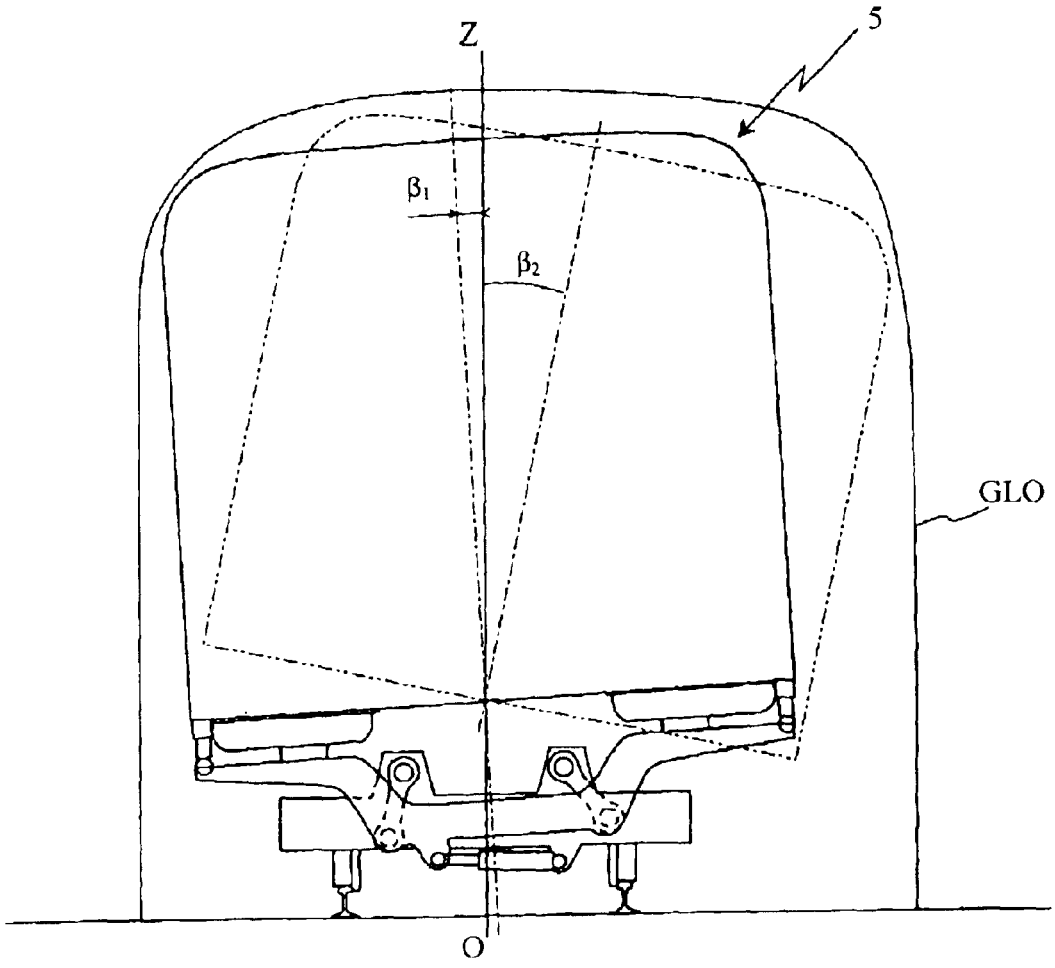
FIG. 3 is a diagrammatic sectional view of a tilting rail vehicle with various tilts within an OFG for a given section of track defined as part of the safe control method according to the invention.

Referring to FIG. 3, the tilt limit values ($\beta_{1i}$, $\beta_{2i}$) correspond to the respective tilt that a body of the vehicle can assume on either side of a plane OZ orthogonal to the plane of the rails in a given section of track. These authorized tilt limit values ($\beta_{1i}$, $\beta_{2i}$) are representative of a safety gauge, also referred to as the obstacle-free gauge (OFG), inside which the vehicle can tilt with no risk of colliding with a track infrastructure or a vehicle traveling on a parallel track.

In a third step 3 of the method, when the authorized tilt limit values ($\beta_{1i}$, $\beta_{2i}$) have been determined for each of the cars $V_i$ of the vehicle 5, the safe automatic protection system actuates mechanical locking means for mechanically preventing tilting of each of the cars $V_i$ beyond the authorized tilt limit values ($\beta_{1i}$, $\beta_{2i}$) previously determined.

Figure 5:
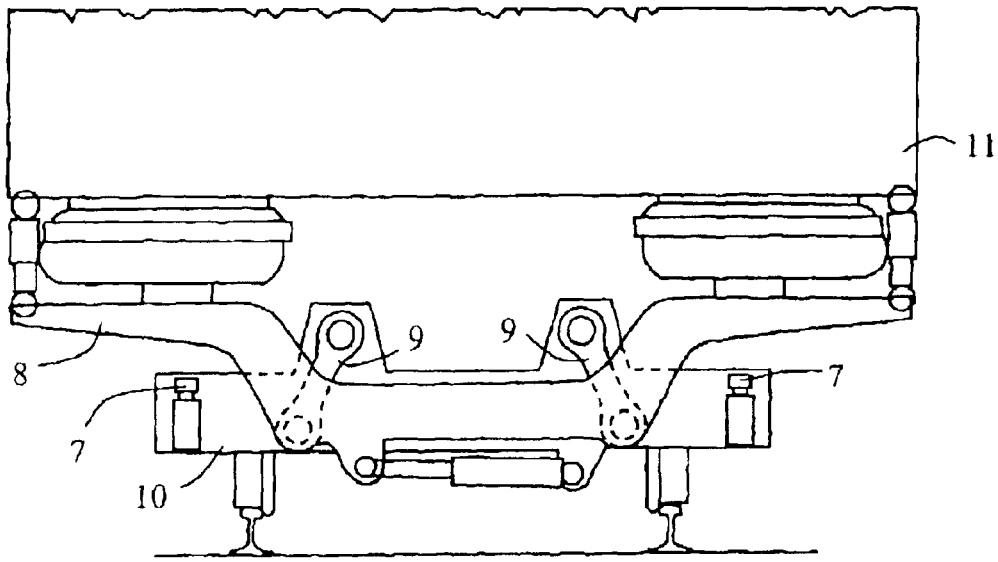
FIG. 5 is a partly sectional front view of a tilting bogie which is equipped with mechanical buffers for implementing the safe tilt control method shown in FIG. 1.
Figure 6:
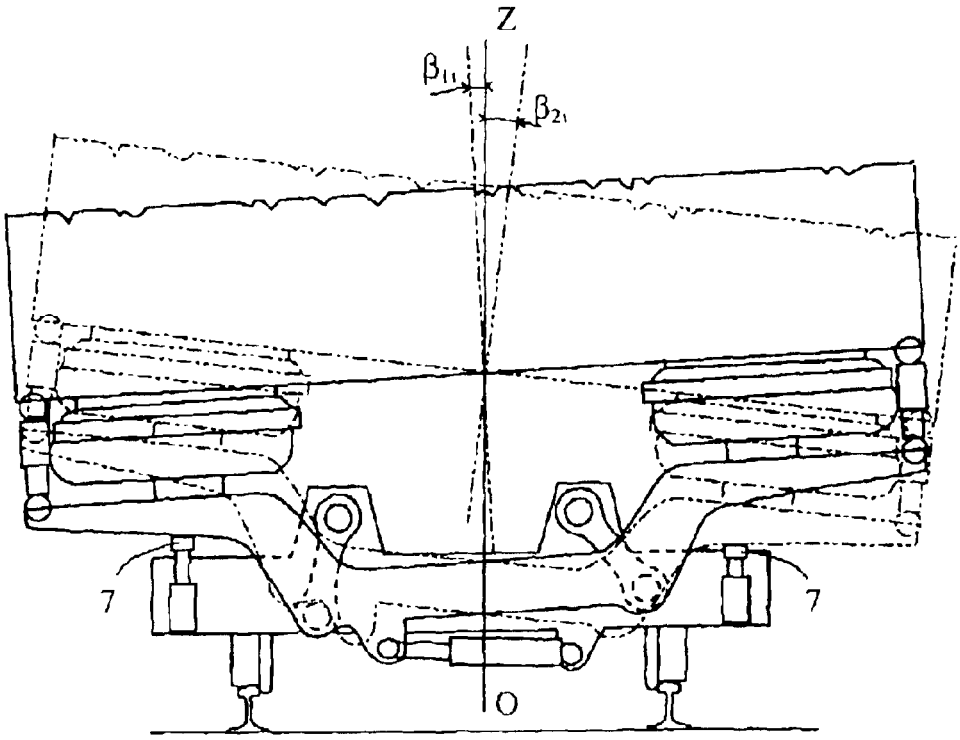
FIG. 6 is a view similar to FIG. 5 in which the mechanical buffers are shown in positions for limiting tilting.

The mechanical locking means are shown in more detail in FIGS. 5 and 6 and consist of two vertically mobile buffers 7 fixed to the chassis 10 of the bogie of the vehicle, for example, the latter supporting the body 11 of the vehicle through the intermediary of a tilt crossmember 8 articulated by means of links 9, like the bogie described in patent application FR 2 756 241. The buffers 7 take the form of hydraulic rams disposed on each side of the bogie chassis 10 and having one end that can move vertically under the tilt crossmember 8.

In FIG. 5, the buffers 7 are shown in a retracted position authorizing maximum tilting of the body 11 relative to the bogie. FIG. 6 shows the position of the buffers 7 when they prohibit tilting of the body 11 beyond authorized tilt limit values ($\beta_{1i}$, $\beta_{2i}$) conforming to step 3 of the method.

After the buffers 7 are moved by the safe protection system, a safety check on the position of each of the buffers 7 is carried out using safety sensors disposed on the rams, and if any error in positioning the buffers 7 is detected an emergency stop procedure is executed or a reduced tilting mode is applied.

Of course, in this embodiment of the invention, the placing of the beacons along the track is adapted to take account of the time necessary for the buffers to move. Accordingly, beacons announcing an approaching track sector in which the limit tilt values are more restricting are placed upstream of the actual junction with the next track sector so that the buffers are already in their more restricted position when the vehicle actually reaches the junction with the next sector. On the other hand, beacons announcing an approaching track sector in which the limit tilt values authorized are less restrictive are located at or slightly downstream of the actual junction with the next sector.

This kind of safe tilt control method has the advantage that it prevents the cars of the vehicle leaving the OFG and thereby improves safety by limiting the risk of the vehicle colliding with known infrastructures alongside the track, for example in the event of failure of the automatic tilt control system. Also, this safe control method operates in parallel with and independently of the automatic tilt control system and therefore provides all of the safety that this kind of system requires. The automatic tilt control system can then be a system requiring no safety features. Thus the safe control method according to the invention can advantageously be integrated into the automatic train protection (ATP) system with which trains are generally equipped, as an additional function.

Moreover, using this kind of safe control method to control the tilting of rail vehicles taking into account the OFG on different track sections limits the vehicle tilt angle only for track sections at risk and therefore preserves optimum tilting performance in other sections.

Figure 2:
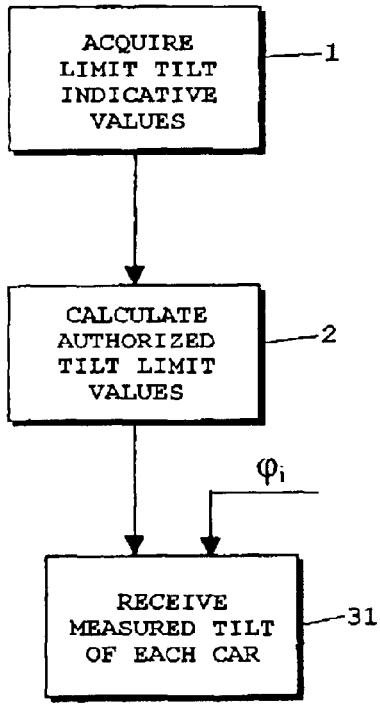
FIG. 2 shows the general architecture of a second embodiment of a control method according to the invention.

FIG. 2 shows a second embodiment of a safe tilt control method according to the invention implemented by an onboard safe protection system 20.

Figure 7:
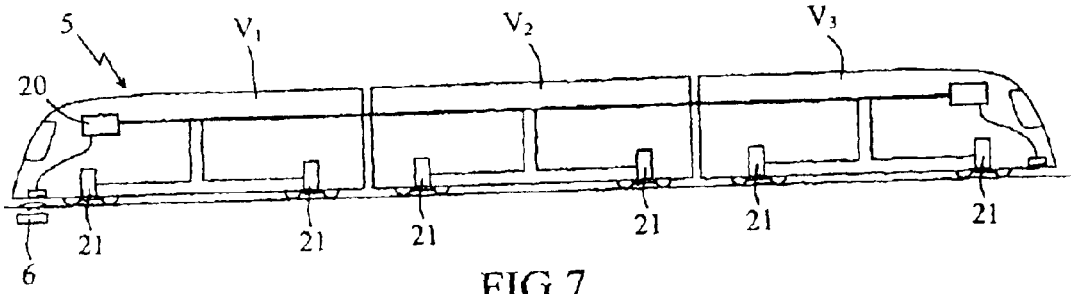
FIG. 7 shows one possible architecture of the safe on board automatic protection system.

In this second embodiment the safe control method includes steps 1 and 2 that are unchanged compared to those described for the first embodiment but includes a step 31, substituted for the step 3 previously described, during which the onboard automatic protection safety system 20 receives a measured tilt $\Phi_i$ of each of the cars $V_i$ of the vehicle, as shown diagrammatically in FIG. 7. The measurements $\Phi_i$ are supplied by safety tilt sensors 21 on the bogies and also used by the automatic tilt control system with which the vehicle 5 is equipped.

The onboard automatic protection safety system 20 compares the measured values $\Phi_i$ transmitted by the sensors with the authorized tilt limit values ($\beta_{1i}$, $\beta_{2i}$) obtained in step 2 of the method to verify that the tilt $\Phi_i$ of each car remains within the values authorized by the OFG, i.e. $\beta_{1i} \leqq \Phi_i \leqq \beta_{2i}$.

If an error is detected, i.e. if one of the measured tilts $\Phi_i$ is outside the authorized tilt limits ($\beta_{1i}$, $\beta_{2i}$), a safety procedure is executed. For the car $V_i$ to which the error relates, the safety procedure can inhibit instructions issued by the automatic tilt control system, zero the tiling of the body 11 and/or (and more safely) execute an emergency stop procedure for the vehicle 5.

This kind of safety control method has the advantage of not requiring additional mechanical buffers on the bogies of the vehicle. However, no anticipation being possible, the onboard automatic tilt protection system integrates a reaction time limiting the performance of the method.

Of course, the invention is in no way limited to the embodiments described and shown, which are provided by way of example only, and which can be modified without departing from the scope of protection of the invention, in particular from the point of view of the composition of the various component parts or by substituting technical equivalents.

Accordingly, in a different embodiment of the method according to the invention, the authorized tilt limit values acquired during the first step of the method could equally well be acquired from a database on board the rail vehicle and containing all the authorized tilt limit values for the track sections over which the rail vehicle travels. In this case, the authorized tilt limit values of the track section over which the vehicle is about to travel are extracted from the database using the known position of the rail vehicle on the track.

We claim:

1. A safe method of controlling the tilt of a vehicle traveling on a track, said vehicle incorporating cars whose tilting is controlled by an automatic control system for tilting said cars as a function of the kinematics of said vehicle and the geometry of said track, said safe method comprising:

allocating to different sections of said track authorized tilt limit values representative of a safety gauge within which said cars of said vehicle tilt without risk of colliding with infrastructures near said track or another vehicle traveling in the opposite direction; and prohibiting, independently of commands issued by said automatic tilt control system, for each car of said vehicle, tilting beyond the authorized tilt limit values allocated to said track section on which said car of said vehicle is located.

2. The method according to claim 1, wherein the prohibiting tilting beyond the authorized tilt limit values comprises mechanically preventing tilting of said car beyond a particular tilt by means of mobile mechanical buffers bearing on the chassis of the bogies of said cars and actuated by actuators, said vehicle comprising a safe onboard automatic tilt protection system preventatively controlling movement of said mechanical buffers on each bogie as a function of the authorized tilt limit values.

3. The method according to claim 2, wherein, after sending instructions controlling said buffers, said safe onboard automatic tilt protection system checks the positions of said buffers by means of sensors.

4. The method according to claim 1, wherein the prohibiting tilting beyond the authorized tilt limit values comprises preventing by a safe automatic tilt protection system on board said vehicle which continuously measures the actual tilt of said cars of said vehicle using sensors, said safe automatic tilt protection system inhibiting any control instruction sent by said automatic tilt control system that would tilt said cars of said vehicle beyond said authorized tilt limit values.

5. The method according to claim 4, further comprising zeroing the tilt of said cars, accompanied by emergency stopping of said vehicle, if the tilt values measured for one of the cars exceed said authorized tilt limit values for said track section on which said car is located.

6. The method according to claim 1, further comprising producing said tilt limit values relating to said track section on which said vehicle is traveling from limit tilt indicative values acquired by a safe automatic tilt protection system on board said vehicle from a beacon disposed upstream of said track section.

7. The method according to claim 1, further comprising:

acquiring values indicative of said authorized tilt limit values on passing beacons for each of said track sections on which said vehicle travels;

storing said acquired values in a memory on board said vehicle; and processing said acquired values by a safe automatic tilt protection system as a function of the known position of said vehicle on said track.

8. The method according to claim 7, wherein said values transmitted by said beacons correspond to the authorized tilt limit values specific to the vehicle of a given type and, if said vehicle traveling on said track is of a different type, said safe automatic tilt protection system on board said vehicle holds vehicle customizing correction coefficients enabling said safe automatic tilt protection system to calculate new authorized tilt limit values suitable for the type of vehicle traveling on said track.

* * * * *